US010941605B2

(12) United States Patent
Warren et al.

(10) Patent No.: US 10,941,605 B2
(45) Date of Patent: Mar. 9, 2021

(54) MODULAR STOREFRONT SYSTEM

(71) Applicant: Prestige Storefront Systems LLC, Bokeelia, FL (US)

(72) Inventors: Timothy Dale Warren, Cape Coral, FL (US); John Matthew Thomas, Bokeelia, FL (US); Alene Ann Garlick, Bokeelia, FL (US)

(73) Assignee: Prestige Storefront Systems LLC, Bokeelia, FL (US)

( * ) Notice: Subject to any disclaimer, the term of this patent is extended or adjusted under 35 U.S.C. 154(b) by 0 days.

(21) Appl. No.: 16/898,998

(22) Filed: Jun. 11, 2020

(65) Prior Publication Data

US 2020/0308896 A1 Oct. 1, 2020

Related U.S. Application Data

(63) Continuation of application No. 15/812,140, filed on Nov. 14, 2017, now abandoned.

(Continued)

(51) Int. Cl.

| | |
|---|---|
| ***E06B 1/04*** | (2006.01) |
| ***E06B 1/38*** | (2006.01) |
| ***E06B 1/52*** | (2006.01) |
| ***E06B 1/32*** | (2006.01) |
| ***E06B 1/36*** | (2006.01) |

(52) U.S. Cl.

CPC ..... *E06B 1/04* (2013.01); *E06B 1/325* (2013.01); *E06B 1/366* (2013.01); *E06B 1/38* (2013.01); *E06B 1/52* (2013.01); *E06B 1/524* (2013.01)

(58) Field of Classification Search

CPC ... E06B 1/32; E06B 1/04; E06B 1/325; E06B 1/40; E06B 1/366; E06B 1/38; E06B 1/52; E06B 1/524

See application file for complete search history.

(56) References Cited

U.S. PATENT DOCUMENTS

| | | | | |
|---|---|---|---|---|
| 3,881,287 A | | 5/1975 | Biebuyck | |
| 4,030,258 A | * | 6/1977 | Anders | E05G 7/002 52/208 |

(Continued)

FOREIGN PATENT DOCUMENTS

| | | |
|---|---|---|
| DE | 10356575 A1 | 10/2004 |
| EP | 1643069 A2 | 4/2006 |

(Continued)

*Primary Examiner* — Christine T Cajilig

(74) *Attorney, Agent, or Firm* — Garlick & Markison; Bruce E. Garlick

(57) ABSTRACT

Prior to dry-in of a building, constructing an outer frame within an external opening of the building by attaching a top piece to a top, attaching a first side piece to a first side, attaching a second side piece to a second side, and attaching a bottom piece to a bottom of the building opening. After constructing the outer frame within the external opening of the building, the method includes mounting glass to glass receiving surfaces of the top piece, the first side piece, the second side piece, and the bottom piece. After dry-in and interior wall finishing of the building, the method includes attaching a plurality of inner base caps to an interior of the outer frame. After dry-in and exterior wall finishing of the building, the method includes attaching a plurality of outer base caps to an exterior of the outer frame.

18 Claims, 15 Drawing Sheets

Related U.S. Application Data

(60) Provisional application No. 62/422,209, filed on Nov. 15, 2016.

(56) References Cited

U.S. PATENT DOCUMENTS

| | | | | |
|---|---|---|---|---|
| 4,614,062 | A | 9/1986 | Sperr | |
| 5,293,723 | A | 3/1994 | Slessor | |
| 5,694,731 | A | 12/1997 | Tonsmann | |
| 8,286,396 | B2 | 10/2012 | Brunnhofer | |
| 10,202,794 | B1 | 2/2019 | Careri | |
| 10,273,744 | B2 | 4/2019 | Lebron | |
| 2005/0183351 | A1 | 8/2005 | Brunnhofer | |
| 2015/0047280 | A1* | 2/2015 | Staten | E04B 2/767 52/281 |
| 2015/0267460 | A1 | 9/2015 | Header | |
| 2016/0047592 | A1 | 2/2016 | Rolek | |
| 2017/0167185 | A1 | 6/2017 | Boer | |

FOREIGN PATENT DOCUMENTS

| | | | |
|---|---|---|---|
| GB | 2206630 | A | 1/1989 |
| GB | 2286005 | A | 8/1995 |
| WO | 2016098122 | A2 | 6/2016 |

* cited by examiner

300

350

600

MODULAR STOREFRONT SYSTEM

CROSS-REFERENCE TO RELATED APPLICATION

The present U.S. Utility Patent Application claims priority pursuant to 35 U.S.C. § 120 as a continuation of U.S. Utility application Ser. No. 15/812,140, entitled "MODULAR STOREFRONT SYSTEM", filed Nov. 14, 2017, which claims priority pursuant to 35 U.S.C. § 119(e) to U.S. Provisional Application No. 62/422,209, entitled "MODULAR STOREFRONT SYSTEM," filed Nov. 15, 2016, all of which are hereby incorporated herein by reference in their entirety and made part of the present U.S. Utility Patent Application for all purposes.

BACKGROUND

Technical Field

The present disclosure relates to window and door installations; and more particularly to storefront systems installed on outer walls of buildings.

Description of Related Art

Storefront systems are generally known to include one or more windows and one or more doors and are generally installed in commercial buildings. The storefront systems are installed on the outer walls of the commercial buildings, with the external side of the storefront systems being external to the building and the internal side of the storefront systems being internal to the building. The storefront systems include an outer frame, typically made of metal, that defines an outer opening, and that is attached to an opening in the building. In some constructs, the outer opening has a single window or single glass door mounted therein. Storefront systems may also include one or more inner frames that define multiple openings with each opening having a glass door or window mounted therein. Some storefront systems include only windows, some storefront systems include only glass doors, and still other storefront systems include both windows and glass doors.

The storefront system outer frames include a top piece, side pieces, horizontal pieces, vertical pieces, and bottom pieces. The side pieces, bottom pieces and top pieces often have same/similar cross-sections while the horizontal piece may have a differing cross-section. Internal frame vertical pieces (mullions) that define inner openings will typically have differing shapes as well. In most prior storefronts, the side pieces, top piece and bottom piece are constructed of a same material, usually extruded metal, e.g., aluminum. The extrusion process causes the piece to have a common cross-sectional shape along its length. The side, top, intermediate and bottom pieces each have internal portions and external portions. When joined together to form the outer frame, the pieces define the outer opening that include a mounting ledge defined to receive a glass panel. Typically, differing designs are required to receive insulated and non-insulated impact glass, due to the differing thicknesses of these impact glasses.

Various shortcomings exist with prior storefront systems. The prior storefront systems are constructed in factories and shipped to job sites for installation. Installation of the storefront systems is typically done just prior to "dry in" of a building. At this point in construction, neither of the inner walls or the outer walls of the building have been finished.

Thus, both the outer side and inner side of the storefront systems are often times damaged after they are installed. While plastic coverings are often placed on the storefront systems when installed, these plastic coverings are easily penetrated by the construction tools used to complete the building.

Because the side pieces, top pieces, intermediate and bottom pieces are formed in single respective (or multiple common) extrusion processes, each are formed of a single material, with the single material being both on the inner side and the outer side of the storefront system. Due to design constraints and the requirement of resisting weather, a compromise on material must be made by the architect of the building. Further, because only certain types of materials may be extruded to form the side pieces, top pieces, and bottom pieces, design choices for the storefront systems are limited. Moreover, because the extrusion process is used to form a unitary structure, aluminum or other metal used to form the pieces provides for substantial thermal communication between the inner and outer sides of the storefront system, resulting in poor energy efficiency of the storefront system.

Prior storefront systems must be totally removed in the event of even minor damage, whether such damage be caused during construction or after construction. Thus, the repair of the prior storefront systems is expensive. Another shortcoming of prior storefront systems is the manner in which they are secured within the respective opening of a building. In most installations, the storefront systems are screwed into the substrate. However, because the prior storefront systems typically have limited connection points to connect their outer frames to the substrate of the opening in the building, the opening in the building must be constructed to receive the prior storefront systems. This often time results in modification to an opening in the building that was created prior to the arrival of the storefront systems.

DETAILED DESCRIPTION OF THE DISCLOSURE

Figure 1:
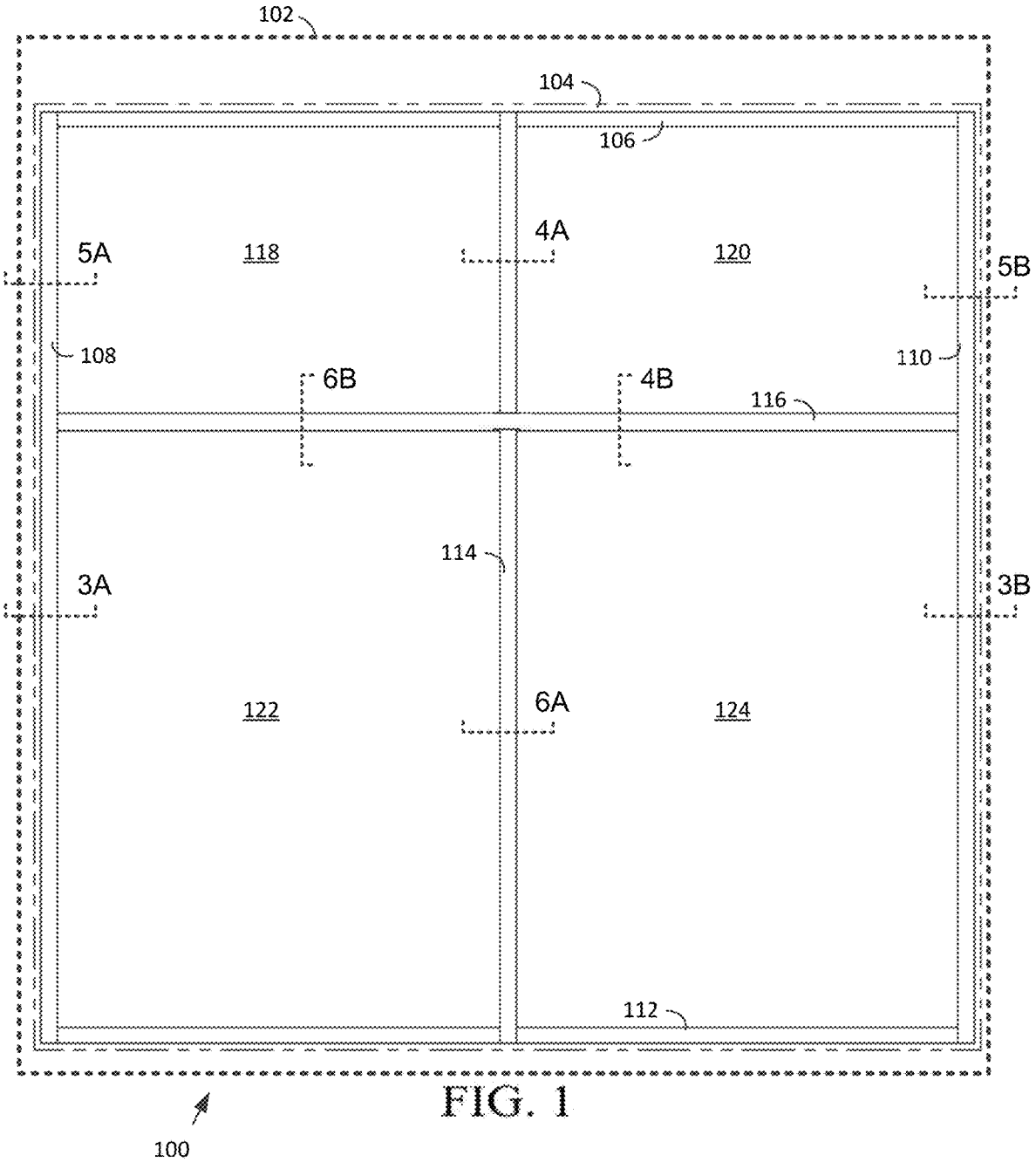
FIG. 1 is a diagram illustrating a storefront system constructed according to one or more aspects of the present disclosure.

FIG. 1 is a diagram illustrating a storefront system 100 constructed according to one or more aspects of the present disclosure. The storefront system 100 mounts within an opening 104 of a building 102 (a portion of a building wall shown). The opening 104 may be within framed walls, poured masonry walls, block wall, steel walls, or other types of walls of the building 102. The storefront system 100 includes an outer frame having a top piece 106, a first side piece 108, a second side piece 110, a bottom piece 112, a vertical mullion 114, a horizontal mullion 116, and windows 118, 120, 122, and 124. The storefront system 100 includes an outer side facing the outside of the building 102 in some embodiments and an inner side facing the inside of the building 102 in some embodiments.

As will be further illustrated in the subsequent FIGS., the top piece 106 has a cross section defined by a glass receiving surface, an inner base cap receiving structure, and an outer base cap receiving structure. The first side piece 108 and the second side piece 110 have cross sections defined by a glass receiving surface, an inner base cap receiving structure, and an outer base cap receiving structure. The vertical mullion 114 has a cross section defined by a glass receiving surface, an inner mullion cap receiving structure, and an outer mullion cap receiving structure. The horizontal mullion 116 has a cross section defined by a glass receiving surface, an inner mullion cap receiving structure, and an outer mullion cap receiving structure. The bottom piece 112 has a cross section defined by a glass receiving surface, an inner base cap receiving structure, and an outer base cap receiving structure. The windows 118, 120, 122, and 124 are glass panels mounted to glass receiving surfaces of the top piece 106, the first side piece 108, the second side piece 110, the vertical mullion 114, the horizontal mullion 116, and the bottom piece 112 as illustrated. The glass of windows 118, 120, 122, and 124 may be single paned, double, paned, or triple paned, for example.

The inner base cap receiving structure of the top piece 106 may be configured to removably receive an inner base cap and an outer base cap mounting structure of the top piece 106 may be configured to removably receive the outer base cap. Likewise, the inner base cap receiving structure of the first side piece 108 may be configured to removably receive an inner base cap and the outer base cap mounting structure of the first side piece 108 may be configured to removably receive an outer base cap. Likewise, the inner base cap receiving structure of the second side piece 110 may be configured to removably receive an inner base cap and the outer base cap mounting structure of the second side piece 110 may be configured to removably receive an outer base cap. Further, the inner mullion cap receiving structure of the vertical mullion 114 may be configured to removably receive an inner mullion cap and the outer mullion cap mounting structure of the vertical mullion 114 is configured to removably receive the outer mullion cap. The inner mullion cap receiving structure of the horizontal mullion 116 may be configured to removably receive an inner mullion cap and the outer mullion cap mounting structure of the horizontal mullion 116 may be configured to removably receive an outer mullion cap. Thus, in some embodiments, the base caps and mullion caps are removably attached to the side pieces 108 and 110, the top piece 104, the bottom piece 112 and the mullions 114 and 116, while in other embodiments, the base caps and mullion caps are not removable after their installation is complete.

With the structure of FIG. 1, the inner base caps and inner mullion caps may include multiple separate segments, the number of which may be defined by the number of openings in the storefront system 100. Further, the outer base caps and outer mullion caps may include multiple separate segments defined in the same manner. In various embodiments, the top piece 106, the first side piece 108, the second side piece 110, the vertical mullion 114, the horizontal mullion 116, and the bottom piece 112 are formed of a first material while the inner base and/or mullion caps are formed of a second material that differs from the first material, and the outer base and/or mullion caps are formed of a third material that differs from the first material. Each of the top piece 106, the first side piece 108, the second side piece 110, the vertical mullion 114, the horizontal mullion 116, and the bottom piece 112 may have multiple sections, the number of which are defined by the number of different defined openings, which receive the window 118, 120, 122, and 124.

According to some aspects of the storefront system 100, the first side piece 108, when in receipt of the outer base cap, defines a first side cap insulating volume with an insulating material contained within the first side cap insulating volume. This same structure may apply to the top piece 106, the second side piece 110, the vertical mullion 114, and the horizontal mullion 116. Each of the top piece 106, the first side piece 108, the second side piece 110, the vertical mullion 114, the horizontal mullion 116, and the bottom piece 112 may have multiple differing anchor locations. Further, each of the top piece 106, the first side piece 108, the second side piece 110, and the bottom piece 112 may have an outer sealing flange that receives sealing material when mounted in the opening 104. The storefront system 100 may or may not include the horizontal mullion 116 or the vertical mullion 114 in differing embodiments.

Figure 2A:
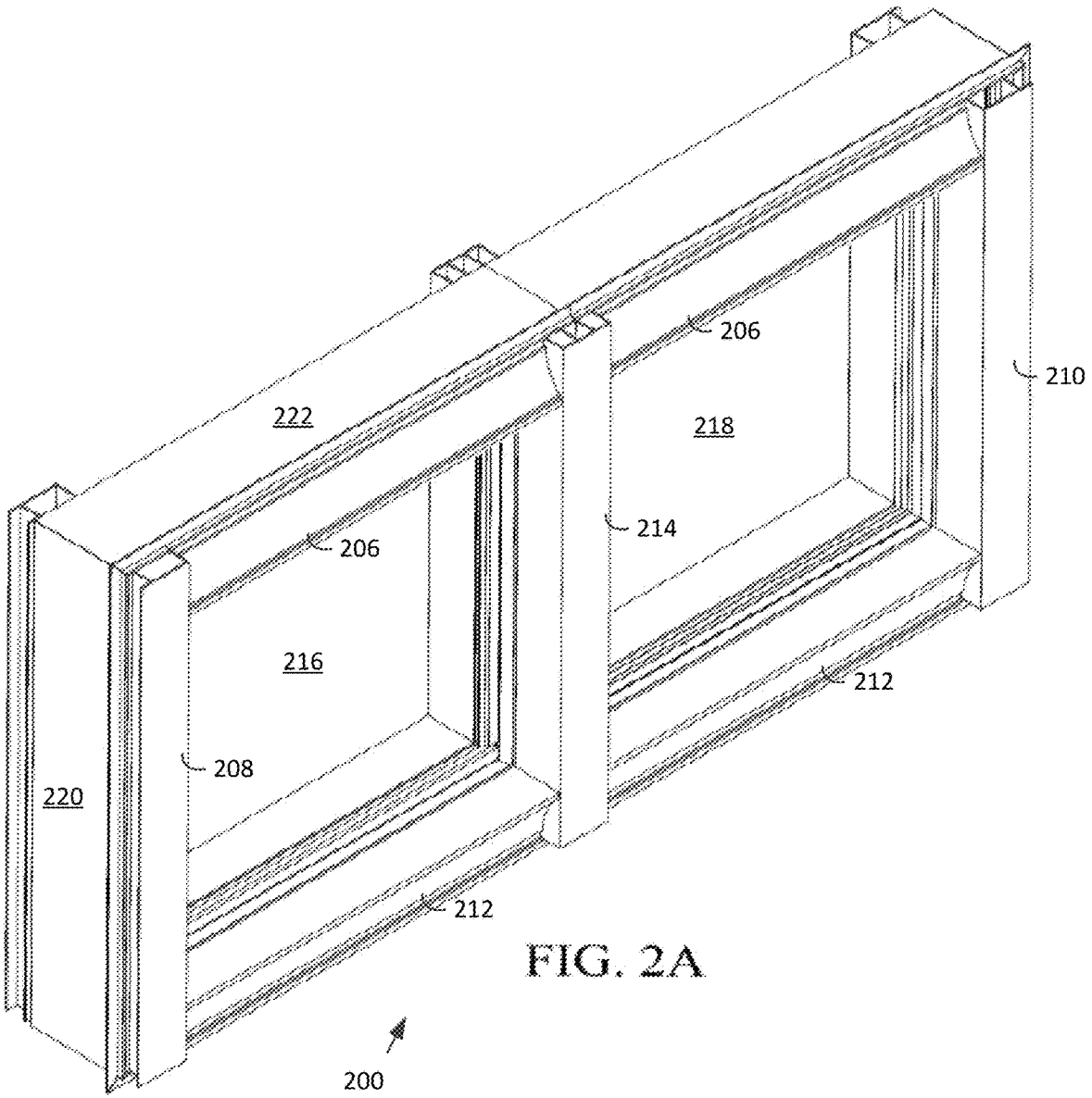
FIGS. 2A and 2B are diagrammatic perspective views of assembled storefront systems constructed according to one or more aspects of the present disclosure.
Figure 2B:
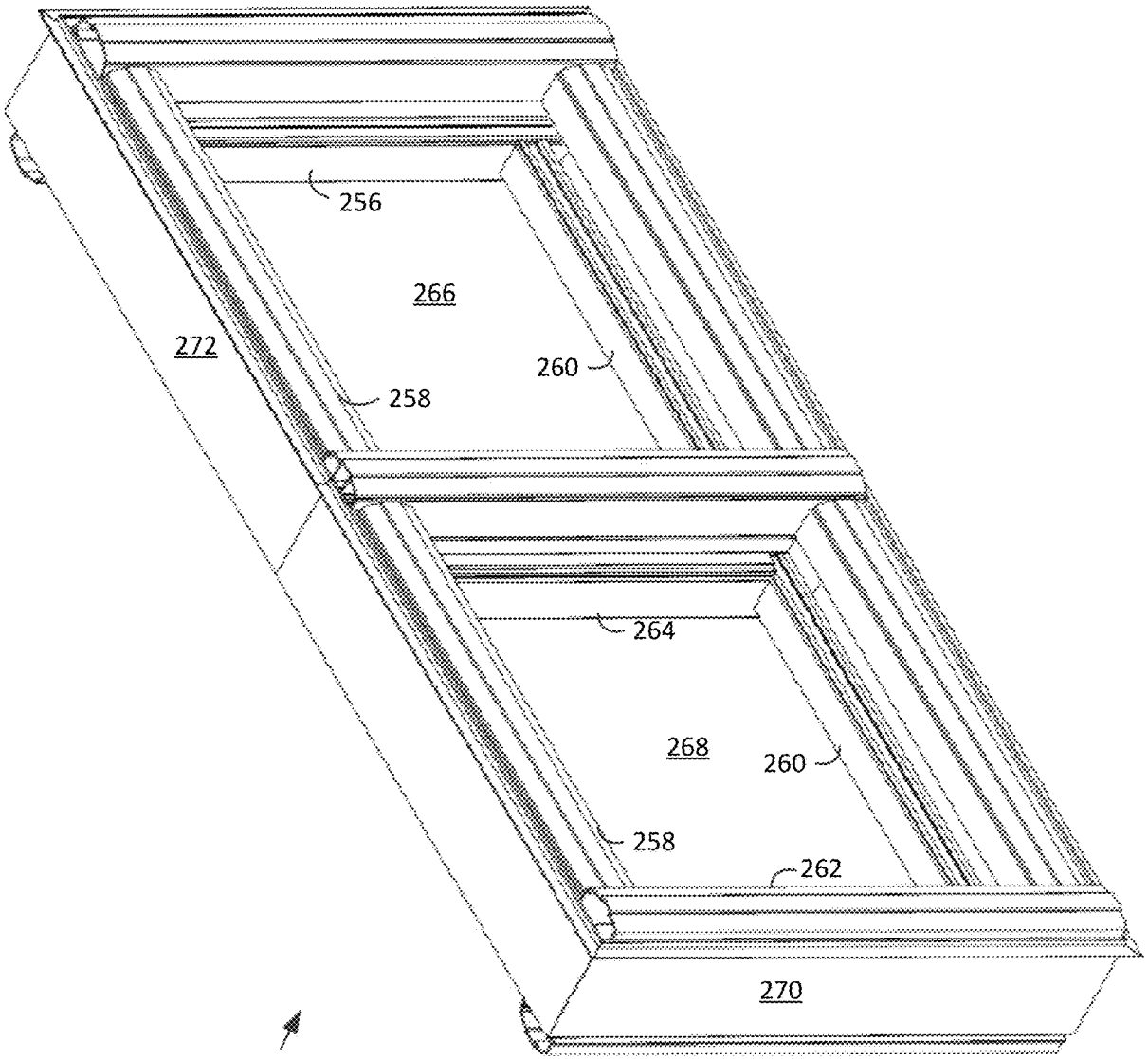
Figure 10A:
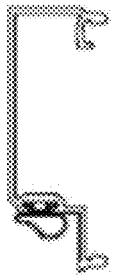
FIGS. 10A and 10B are cross-sectional views of door stops of a storefront system constructed according to one or more aspects of the present disclosure.
Figure 10B:
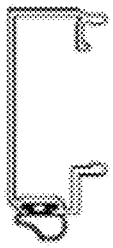
Figure 12A:
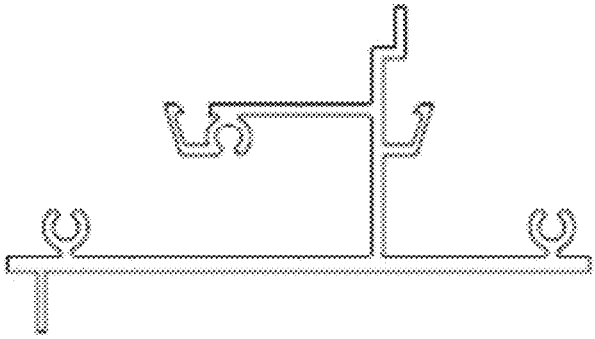
FIG. 12A is a cross-sectional view of a side piece a storefront system constructed according to one or more aspects of the present disclosure.
Figure 12B:
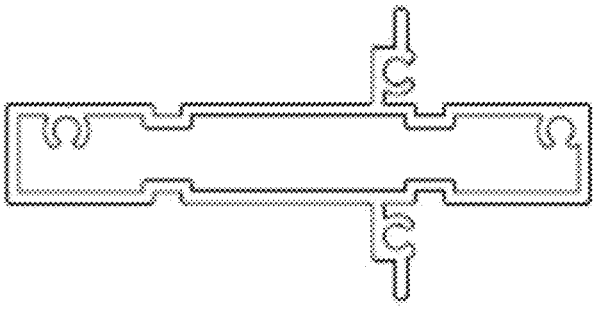
FIG. 12B is a cross-sectional view of a horizontal mullion piece of a storefront system constructed according to one or more aspects of the present disclosure.
Figure 12C:
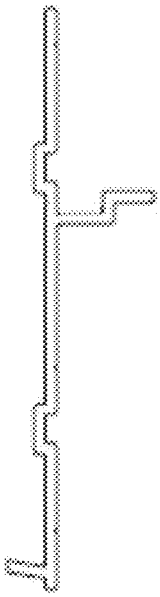
FIG. 12C is a cross-sectional view of one-half of a vertical mullion piece of a storefront system constructed according to one or more aspects of the present disclosure.

FIGS. 2A and 2B are diagrammatic perspective views of assembled storefront systems constructed according to one or more aspects of the present disclosure. Referring to FIG. 2A, the storefront system 200 includes a rectangular structure with two outer surfaces 220 and 222 shown, (also includes two additional outer surfaces, not shown), which attach to an opening in a building. Examples of how these outer surfaces 220 and 222 attach to the opening in the building will be shown in detail in FIGS. 3A, 3B and 7A. Vertical side pieces 208 and 210 have structures illustrated respectively in FIGS. 3A and 3B that include inner base caps and outer base caps, for example. Vertical mullion 214 extends between bottom piece 212 and top piece 206. Windows 216 and 218 have glass panes that reside within openings defined by the vertical pieces 208 and 210, bottom piece 212, top piece 206, and the vertical mullion 214. Particular examples of these structures will be described with reference to FIGS. 3A, 3B, 4A, 4B, 5A, 5B, 6A, and 6B. Examples of mullion caps are illustrated in FIGS. 8A-8H. Examples of base caps are illustrated in FIGS. 9A-9G. An example of vertical side pieces 208 and 210 and top piece 206 is illustrated in FIG. 12A. Examples of bottom piece 212 are illustrated in FIGS. 10A and 10B. An example of the horizontal mullion is illustrated in FIG. 12Ba and an example of one piece of a two-piece vertical mullion is illustrated in FIG. 12C.

Referring to FIG. 2B, the storefront system 250 includes a rectangular structure with two outer surfaces 270 and 272 shown (also includes two additional outer surfaces, not shown), which couple to surfaces of an opening in a building. Examples of how these outer surfaces 270 and 272 attach to the opening in the building will be shown in detail in FIGS. 3A, 3B and 7A. Vertical side pieces 258 and 260 have structures illustrated respectively in FIGS. 3A and 3B, for example. Horizontal mullion 264 extends between side piece 258 and side piece 260. Windows 266 and 268 have glass panes are reside within openings defined by the vertical side pieces 258 and 260, the bottom piece 262, the top piece 256, and the horizontal mullion 264. Note that base caps and mullion caps of the embodiment of FIG. 2B differ as compared to the embodiment of FIG. 2A. Further, note that the embodiments of FIGS. 2A and 2B are similar, except for the orientation of the storefront system 250 as compared to the storefront system 200.

Figure 3A:
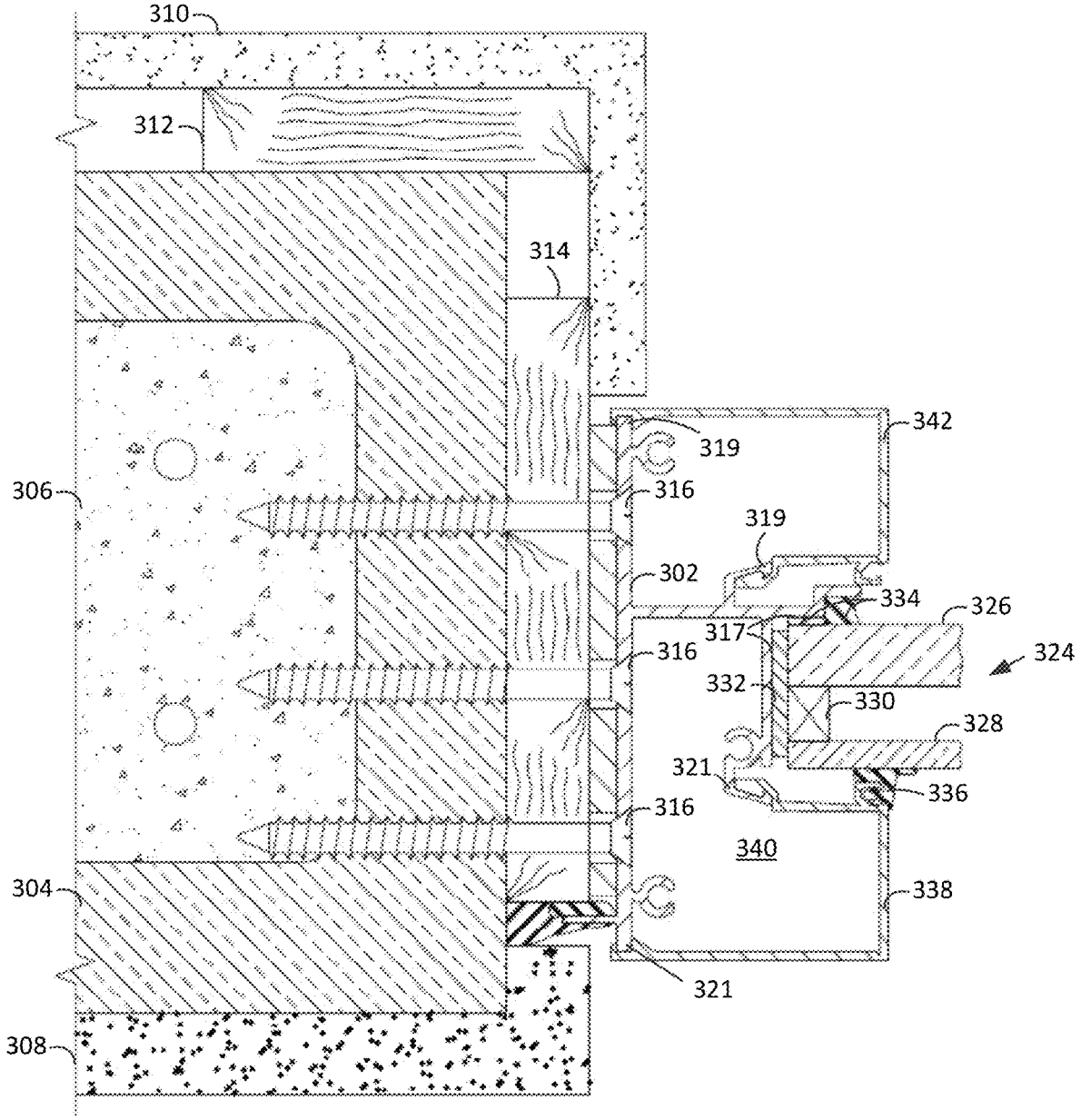
FIG. 3A is a horizontal cross-sectional view of an installed side piece taken along section 3A of the storefront system of FIG. 1 according to one or more aspects of the present disclosure.

FIG. 3A is a horizontal cross-sectional view of an installed side piece taken along section 3A of the storefront system of FIG. 1 according to one or more aspects of the present disclosure. With the embodiment 300 of FIG. 3A, a first side piece 302 attaches to the wall of an opening formed in a building using screws 316. The building wall may include an outer portion 304, formed of concrete, for example, and an inner portion 306 that is an insulative core. Stucco 308 may be formed on an outside wall of the building and drywall 310 (or other interior wall material) may couple to the building wall via spacers 312, e.g., wood slats. Wood bucking 314 may reside between the first side piece 302 and the outer portion 304 of the wall with the screws 316 extending thorough the first side piece 302, through the wood bucking 314, through the outer portion 304 and into the inner portion 306. Sets of screws 316 may be distributed along the height of the first side piece 302 from a bottom of the opening to a top of the opening.

The first side piece 302 has a first side piece cross section defined by a glass receiving surface 317, an inner base cap receiving structure 319, and an outer base cap receiving structure 321. Note that the glass receiving surface 317 may reside in two dimensions, e.g., multiple segments perpendicular to each other. The inner base cap receiving structure 319 may include multiple surfaces that are configured to receive an inner base cap 342. Likewise, the outer base cap receiving structure 321 may include multiple surfaces that are configured to receive an outer base cap 338. Note that a base cap insulating volume 340 is defined between the side piece 302 and the outer base cap 338, which may be filled with an insulative material to increase the thermal efficiency of the storefront. As will be described further herein, the outer surfacing, e.g., stucco 308, and the drywall 310 may be installed after the first side piece 302 is attached to the outer portion 304 of the wall but prior to the attachment of an inner base cap 342 and an outer base cap 338.

A glass panel 324 couples to the first side piece 302 via adhesive 334 at the glass receiving surface 317. The glass panel 324 is double paned in the example of FIG. 3A and includes inner glass pane 326, outer glass pane 328 and spacer 330, which serves to isolate a volume between the inner glass pane 326 and the outer glass pane 328. The glass panel 324 may also include spacer/adhesive 332 that resides between the first side piece 302 and the inner glass pane 326 and outer glass pane 328. Adhesive/filler 334 adheres the glass panel 324 to the glass receiving surface 317 of the first side piece 302. Insulator 336 forms a seal between the outer glass pane 328 and the outer base cap 338.

Figure 3B:
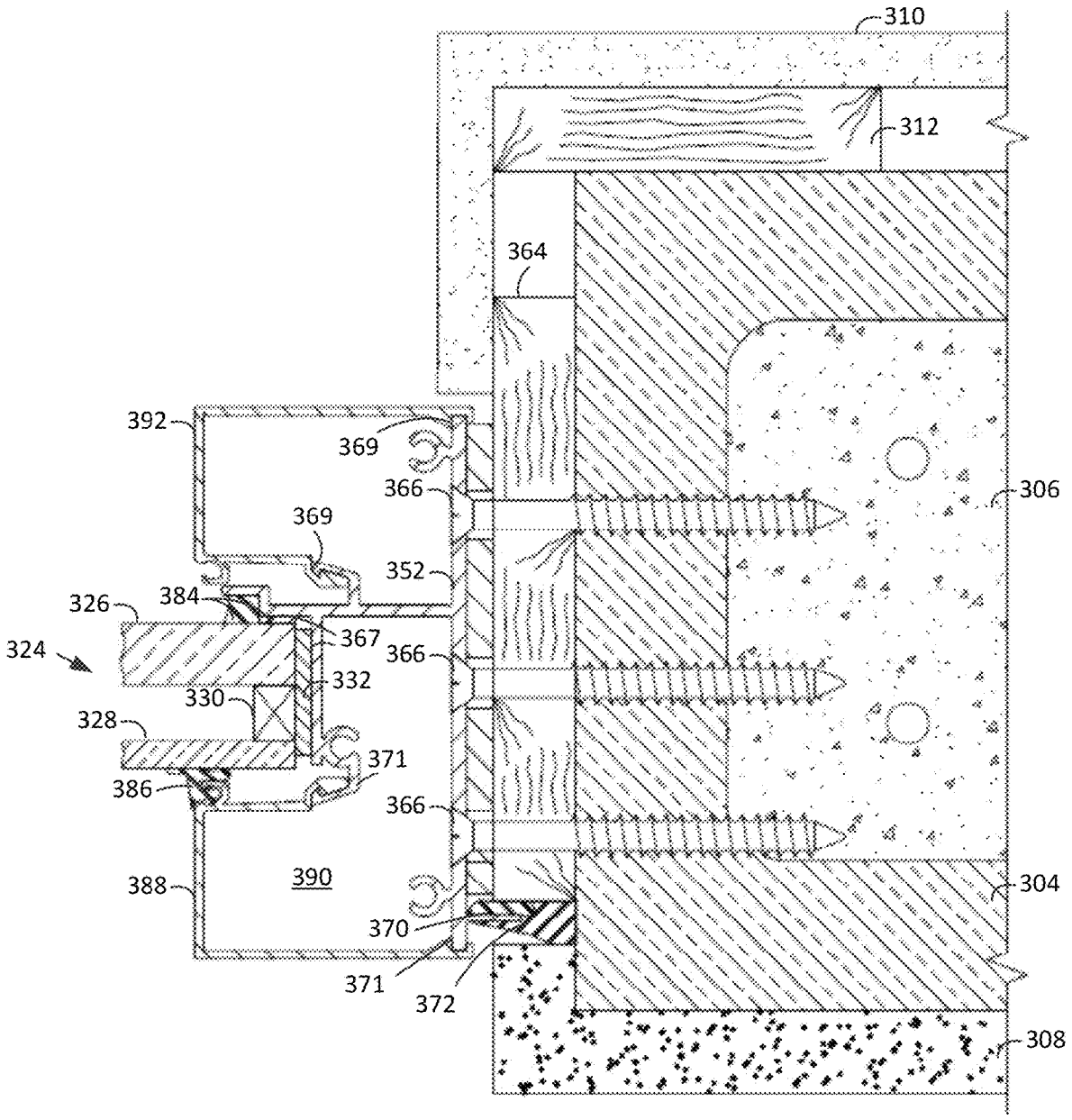
FIG. 3B is a horizontal cross-sectional view of an installed side piece taken along section 3B of the storefront system of FIG. 1 according to one or more aspects of the present disclosure.

FIG. 3B is a horizontal cross-sectional view of an installed side piece taken along section 3B of the storefront system of FIG. 1 according to one or more aspects of the present disclosure. Numbering of common components between FIGS. 3A and 3B is retained. With the embodiment 350 of FIG. 3B, a second side piece 352 attaches to the wall of an opening formed in a building using screws 366. The building wall may be of the same structure as described with reference to FIG. 3A. Wood bucking 364 may reside between the second side piece 352 and the outer portion 304 of the wall with the screws 366 extending thorough the second side piece 352, through the wood bucking 364, through the outer portion 304, and into the inner portion 306. The screws 366 may be distributed along the height of the second side piece 352 from a bottom of the opening to a top of the opening.

The second side piece 352 has a second side piece cross section defined by a glass receiving surface 367, an inner base cap receiving structure 369, and an outer base cap receiving structure 371. Note that the glass receiving surface 367 may reside in two dimensions, e.g., multiple segments perpendicular to each other. The inner base cap receiving structure 369 may include multiple surfaces that are configured to receive an inner base cap 392. Likewise, the outer base cap receiving structure 371 may include multiple surfaces that are configured to receive an outer base cap 388. Note that a base cap insulating volume 390 is defined between the second side piece 352 and the outer base cap 388, which may be filled with an insulative material to increase the thermal efficiency of the storefront.

The glass panel 324 couples to the second side piece 352 via adhesive/filler 384 at the glass receiving surface 367. The glass panel 324 is double paned as in the example of FIG. 3A and includes inner glass pane 326, outer glass pane 328, and spacer 330, which serves to isolate a volume between the inner glass pane 326 and the outer glass pane 328. The glass panel 324 may also include spacer/adhesive 332 that resides between the second side piece 352 and the glass panes 326 and 328. Adhesive 384 adheres the glass panel 324 to the glass receiving surface 367 of the second side piece 352. Insulator 386 forms a seal between the outer glass pane 328 and the outer base cap 388.

Note that the top piece 106 of the storefront system 100 may have structure same or similar to the structure of FIG. 3A or 3B. Further, the bottom piece of the storefront system 100 may have a similar structure, to the top piece 106.

Figure 4A:
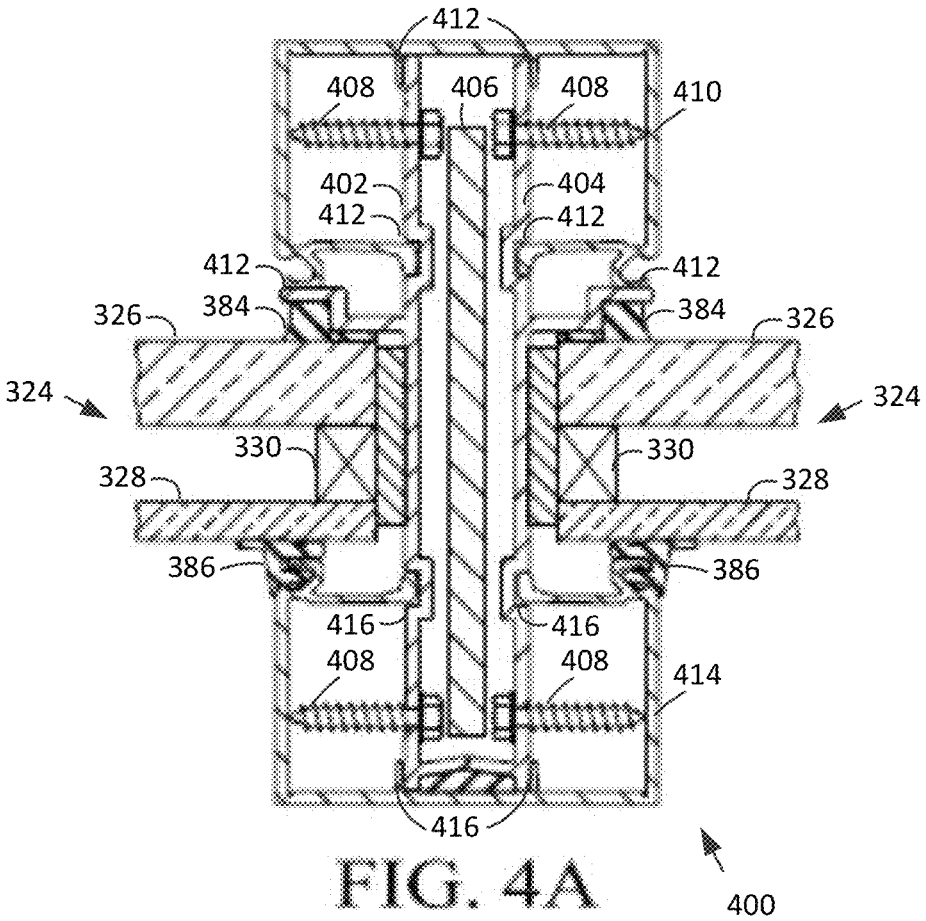
FIG. 4A is a horizontal cross-sectional view of an installed vertical mullion taken along section 4A of the storefront system of FIG. 1 according to one or more aspects of the present disclosure.

FIG. 4A is a horizontal cross-sectional view of an installed vertical mullion taken along section 4A of the storefront system of FIG. 1 according to one or more aspects of the present disclosure. Common numbering from FIGS. 3A and 3B is used in FIG. 4A. The vertical mullion 400 includes first section 402 and second section 404 separated by a spacer 406. Glass panel 324 has same/similar structure as the glass panel 324 described with reference to FIGS. 3A and 3B. When the first section 402 and second section 404 are assembled and installed, the vertical mullion extends between two horizontal structures, which include two or more of a top piece, a bottom piece, and/or a horizontal mullion. Bolts 408 may extend horizontally through the first section 402 and the second section 404 to mount the first section and the second section 404 within the building opening, securing the vertical mullion 400 to a top piece, a bottom piece, and/or a horizontal mullion. The vertical mullion 400 may alternatively be fixed to these horizontal structures via adhesive or other mechanical means. Further, the glass panel 324, with its attaching adhesive 384, may assist in holding the vertical mullion 400 in place. Note that the bolts 408 are illustrated for describing mounting and they may only be at a top end and/or a bottom end of the vertical mullion 400.

The first section 402 and second section 404, after assembly, form an inner mullion cap receiving structure 412 (multiple locations) that is configured to receive the inner mullion cap 410. Further, the first section 402 and second section 404, after assembly, form an outer mullion cap receiving structure 416 (multiple locations) that is configured to receive the outer mullion cap 414.

Figure 4B:
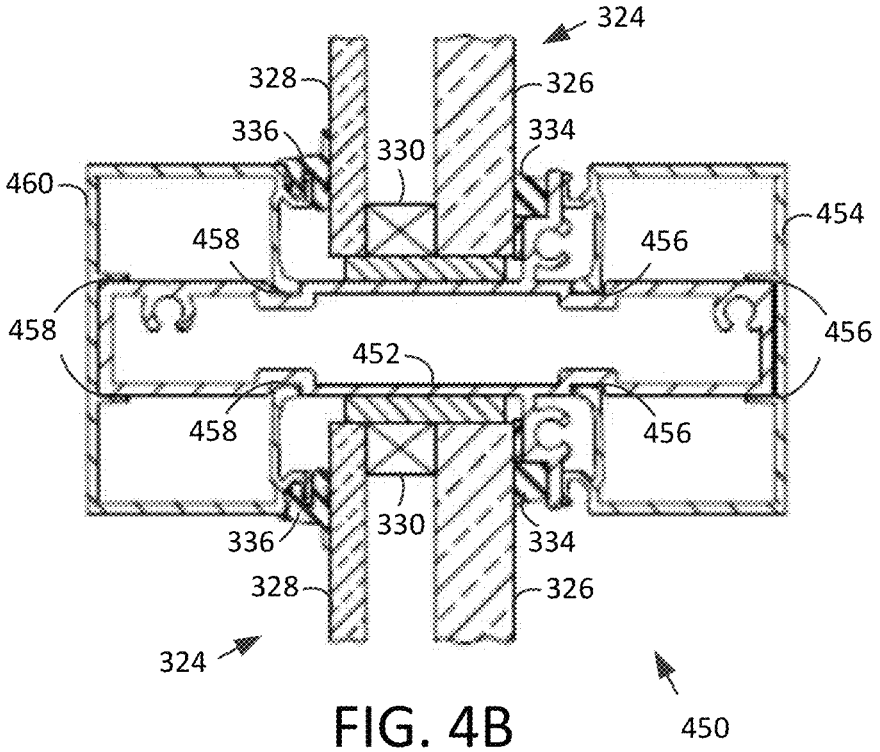
FIG. 4B is a vertical cross-sectional view of an installed horizontal mullion taken along section 4B of the storefront system of FIG. 1 according to one or more aspects of the present disclosure.

FIG. 4B is a vertical cross-sectional view of an installed horizontal mullion taken along section 4B of the storefront system of FIG. 1 according to one or more aspects of the present disclosure. Common numbering from FIGS. 3A and 3B is used in FIG. 4B. Glass panel 324 has same/similar structure as the glass panel 324 described with reference to FIGS. 3A, 3B and 4A. The horizontal mullion 450 includes a horizontal mullion piece 452 having an inner mullion receiving structure 456 for receiving an inner mullion cap 454. The inner mullion receiving structure 456 includes a plurality of surfaces that receive complementary segments of the inner mullion cap 454. The horizontal mullion 452 also has an outer mullion receiving structure 458 for receiving an outer mullion cap 460. The outer mullion receiving structure 458 includes a plurality of surfaces that receive complementary segments of the outer mullion cap 460. The glass panel 324 mounts to the horizontal mullion piece 452 similarly to the manner that the glass panel 324 mounts to a vertical mullion piece 402 or 404, to a side piece 302 or 352, or to a top piece.

Figure 5B:
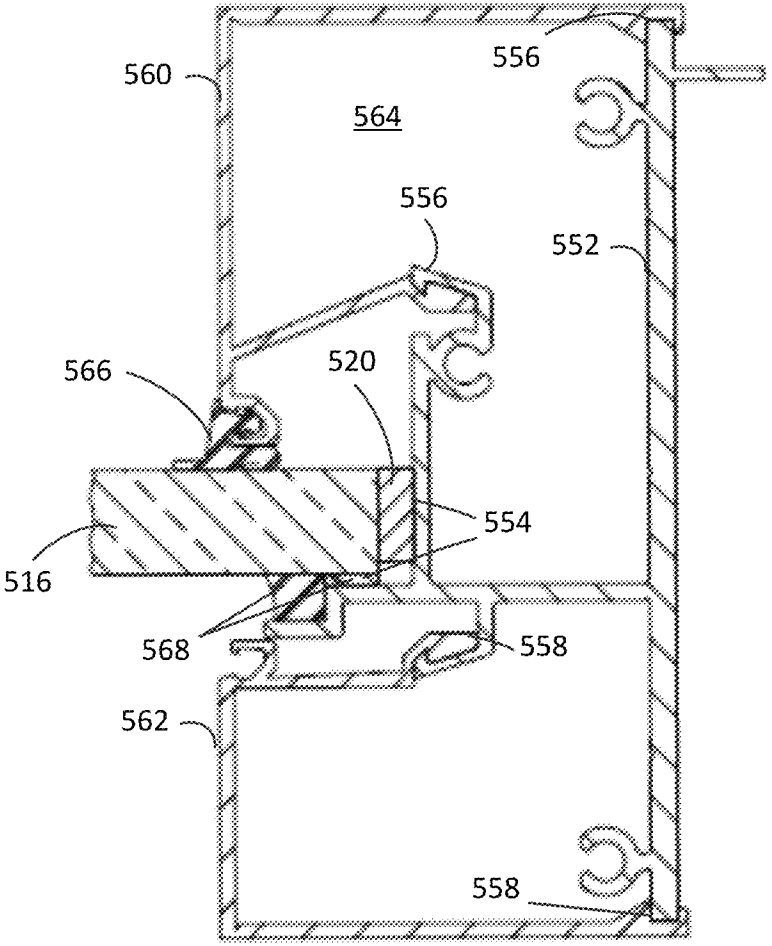
FIG. 5B is a horizontal cross-sectional view of a differing embodiment of an installed side piece taken along section 5B of the storefront system of FIG. 1 according to one or more aspects of the present disclosure.
Figure 5A:
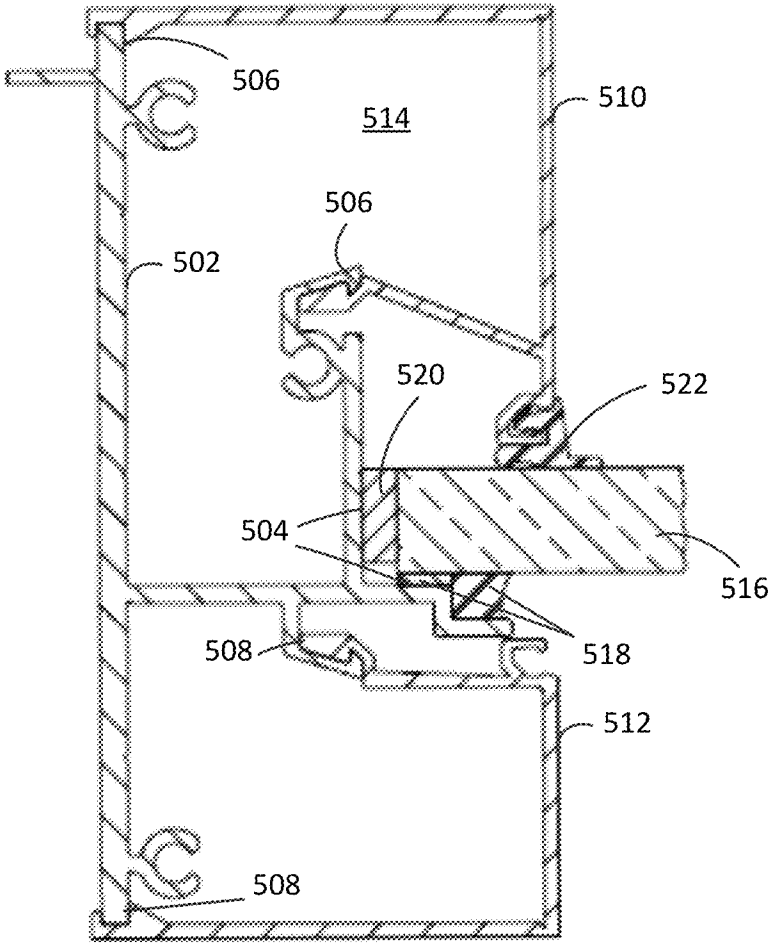
FIG. 5A is a horizontal cross-sectional view of a differing embodiment of an installed side piece taken along section 5A of the storefront system of FIG. 1 according to one or more aspects of the present disclosure.

FIG. 5A is a horizontal cross-sectional view of a differing embodiment of an installed side piece taken along section 5A of the storefront system of FIG. 1 according to one or more aspects of the present disclosure. With the embodiment 500 of FIG. 5A, a first side piece 502 may be attached to the wall of an opening formed in a building. The first side piece 502 has a first side piece cross section defined by a glass receiving surface 504, an inner base cap receiving structure 508, and an outer base cap receiving structure 506. Note that the glass receiving surface 504 may reside in two dimensions, e.g., multiple segments perpendicular to each other. The inner base cap receiving structure 508 may include multiple surfaces that are configured to receive an inner base cap 512. Likewise, the outer base cap receiving structure 506 may include multiple surfaces that are configured to receive an outer base cap 510. Note that a base cap insulating volume 514 is defined between the side piece 502 and the outer base cap 510, which may be filled with an insulative material to increase the thermal efficiency of the storefront.

A glass panel 516 couples to the first side piece 502 via adhesive 518 at the glass receiving surface 504 (may include a spacer 520). Note that the adhesive 518 may include multiple segments applied at differing times. Further, the adhesive 518 may be first applied and an insulative sealant may be secondarily applied. The glass panel 516 is single paned in the example of FIG. 5A. Insulator 522 forms a seal between the glass panel 516 and the outer base cap 510.

FIG. 5B is a horizontal cross-sectional view of a differing embodiment of an installed side piece taken along section 5B of the storefront system of FIG. 1 according to one or more aspects of the present disclosure. FIG. 5B retains common numbering with FIG. 5A. With the embodiment 550 of FIG. 5B, a second side piece 552 may be attached to the wall of an opening formed in a building. The second side piece 552 has a second side piece cross section defined by a glass receiving surface 554, an inner base cap receiving structure 558, and an outer base cap receiving structure 556. Note that the glass receiving surface 554 may reside in two dimensions, e.g., multiple segments perpendicular to each other. The inner base cap receiving structure 558 may include multiple surfaces that are configured to receive an inner base cap 562. Likewise, the outer base cap receiving structure 556 may include multiple surfaces that are configured to receive an outer base cap 560. Note that a base cap insulating volume 564 is defined between the second side piece 552 and the outer base cap 560, which may be filled with an insulative material to increase the thermal efficiency of the storefront.

Glass panel 516 couples to the second side piece 552 via adhesive 568 at the glass receiving surface 554 (may include a spacer 520). Note that the adhesive 568 may include multiple segments applied at differing times. Further, the adhesive 568 may be first applied and an insulative sealant may be secondarily applied. The glass panel 516 is single paned in the example of FIG. 5B. Insulator 566 forms a seal between the glass panel 516 and the outer base cap 560.

Figure 6A:
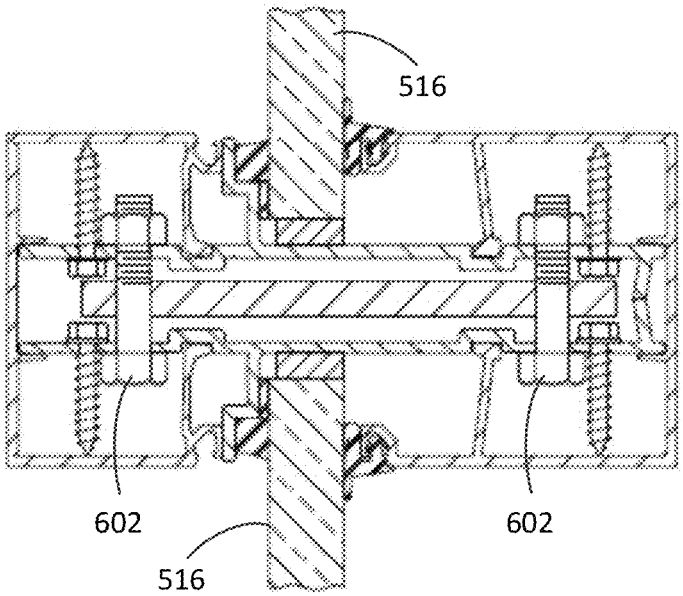
FIG. 6A is a horizontal cross-sectional view of a differing embodiment of a vertical mullion taken along section 4A of the storefront system of FIG. 1 according to one or more aspects of the present disclosure.

FIG. 6A is a horizontal cross-sectional view of a differing embodiment of a vertical mullion taken along section 4A of the storefront system of FIG. 1 according to one or more aspects of the present disclosure. The vertical mullion 600 is of a similar structure to the vertical mullion 400 illustrated in FIG. 4A. With the vertical mullion 600 of FIG. 6A, glass panel 516 couples to the vertical mullion 600. Further, the first piece and second piece of the vertical mullion 600 are held together by nuts and bolts 602. The structure of the vertical mullion 600 of FIG. 6A may differ slightly to accommodate the differing glass structure and nuts bolts 602. The nuts and bolts 602 may also serve to mount the vertical mullion to a top piece, a bottom piece, and/or a horizontal mullion.

Figure 6B:
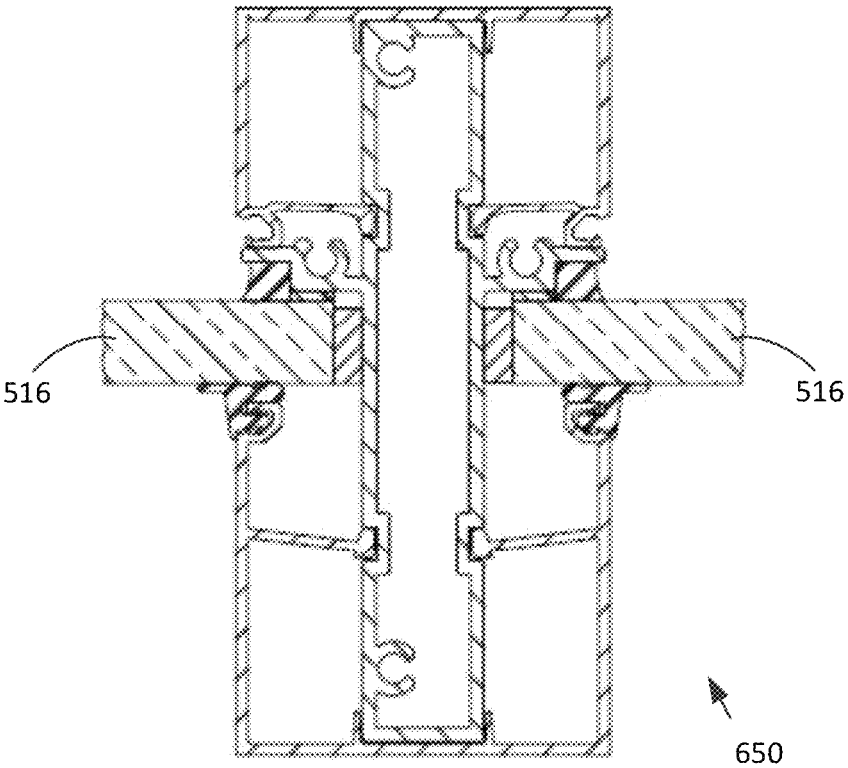
FIG. 6B is a vertical cross-sectional view of a differing embodiment of a horizontal mullion taken along section 4B of the storefront system of FIG. 1 according to one or more aspects of the present disclosure.

FIG. 6B is a vertical cross-sectional view of a differing embodiment of a horizontal mullion taken along section 4B of the storefront system of FIG. 1 according to one or more aspects of the present disclosure. The horizontal mullion 650 is of a similar structure to the horizontal mullion 450 illustrated in FIG. 4B. With the horizontal mullion 650 of FIG. 6B, glass panel 516 couples to the vertical mullion 650. The structure of the horizontal mullion 650 of FIG. 6B may differ slightly to accommodate the differing glass structure.

Figure 7A:
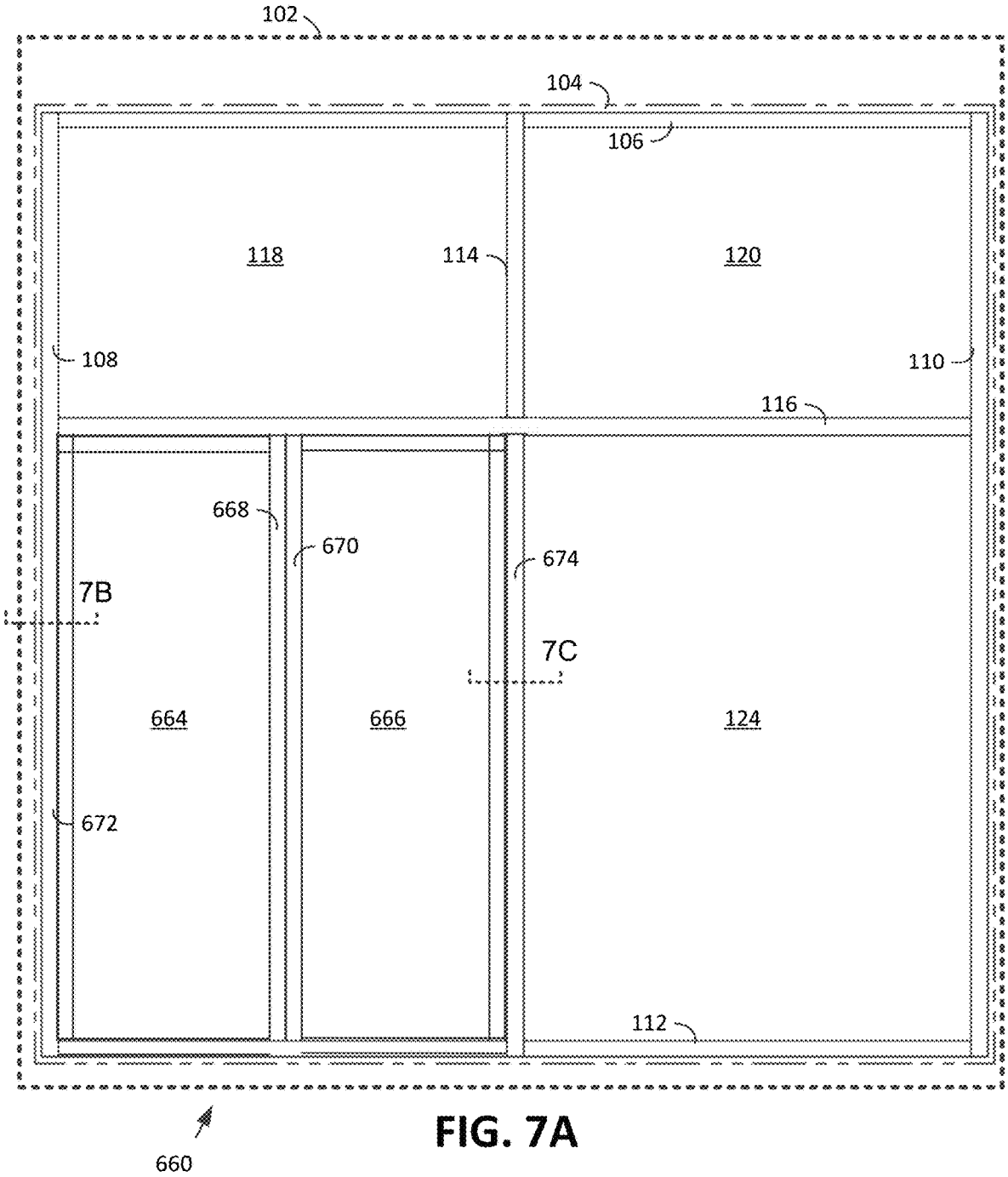
FIG. 7A is a diagram illustrating a storefront system constructed according to one or more aspects of the present disclosure.

FIG. 7A is a diagram illustrating a storefront system constructed according to one or more aspects of the present disclosure. FIG. 1 and FIG. 7A share commonly numbered components, most of which will not be described further herein with reference to FIG. 7A. A difference between the storefront system 660 of FIG. 7A as compared to the storefront system 100 of FIG. 1 is that instead of window 122, storefront system 660 of FIG. 7A includes doors 664 and 666 having abutting door frames 668 and 670, respectively. With this difference, the side piece 672 that services door frame 668 differs from the side piece 108 that services window 118 and a vertical mullion 674 that services door frame 670 differs from a vertical mullion 114 that services window 118.

Figure 7B:
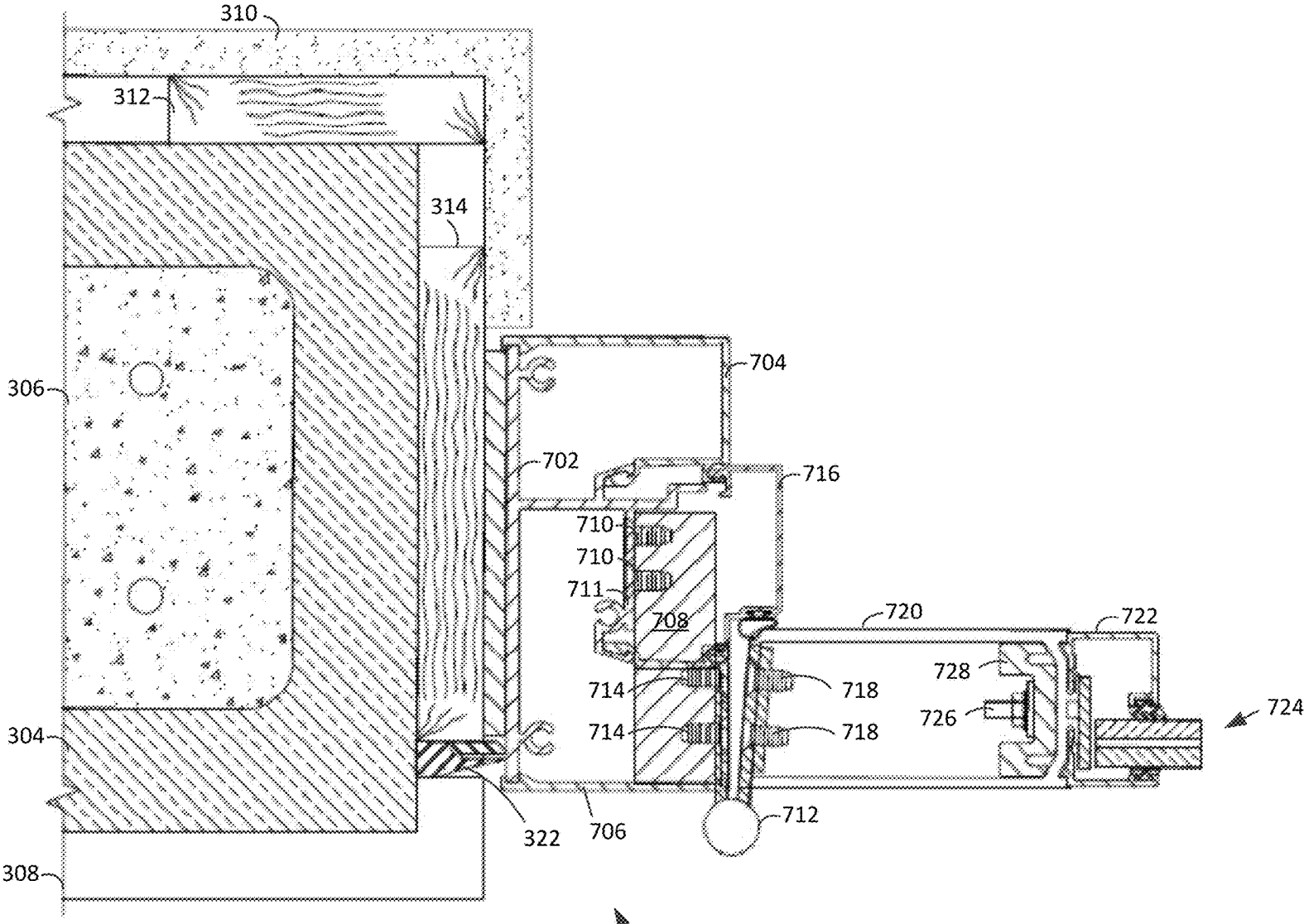
FIG. 7B is a horizontal cross-sectional view of a door assembly attached to a sidepiece of a storefront system taken along section line 7B of FIG. 7A and constructed according to one or more aspects of the present disclosure.

FIG. 7B is a horizontal cross-sectional view of a door assembly attached to a sidepiece of a storefront system taken along section line 7B of FIG. 7A and constructed according to one or more aspects of the present disclosure. The side piece 702 couples to the outer portion 304 of the building via a wood buck 314 using screws or other suitable connectors. A door hinge backing 708 couples to the side piece 702 via screws 710 at a door hinge backing location 711 of the side piece 702. Outer base cap 706 couples to side piece 702 at connection points as was previously described herein. Hinge 712 couples to door hinge backing 708 via screws 714 and to door frame 720 via screws 718. Door stop 716 couples to inner base cap 704 and to outer base cap 706 and/or side piece 702. Door frame 720 couples to window frame 722 via bolt 726 and bracket 728. Contained in window frame 722 is double pane glass 724.

Figure 7C:
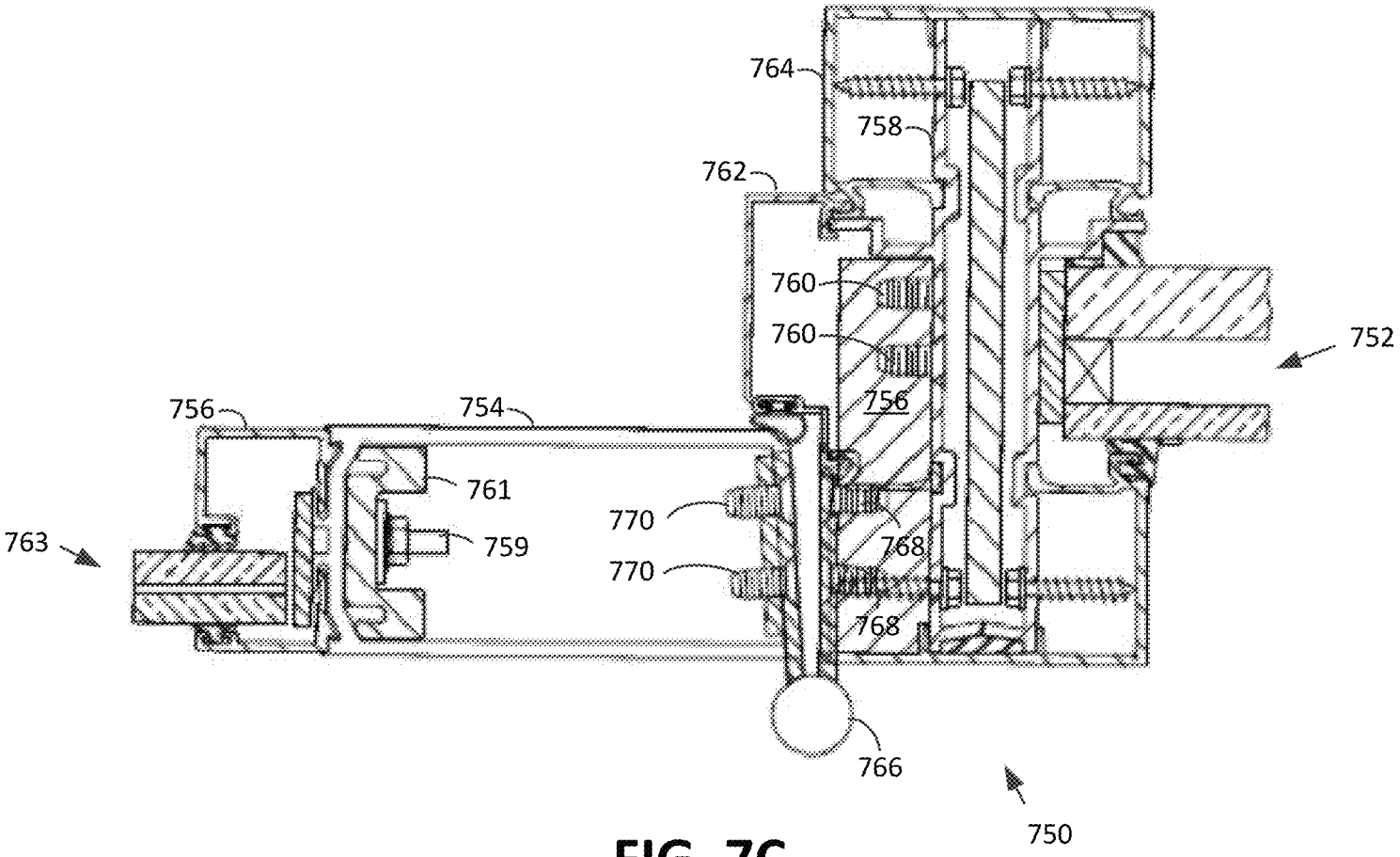
FIG. 7C is a horizontal cross-sectional view of a door assembly attached to a vertical mullion of a storefront system taken along section line 7C of FIG. 7A and constructed according to one or more aspects of the present disclosure.
Figure 8A:
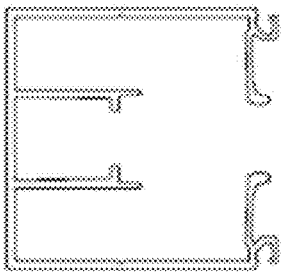
FIGS. 8A-8H are cross-sectional views of a plurality of mullion caps of a storefront system constructed according to one or more aspects of the present disclosure.
Figure 8B:
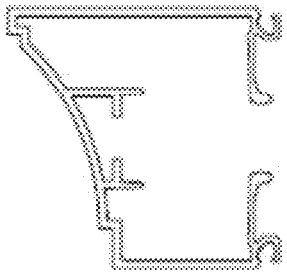
Figure 8C:
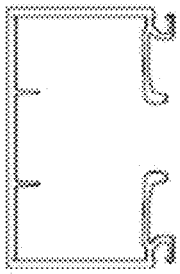
Figure 8D:
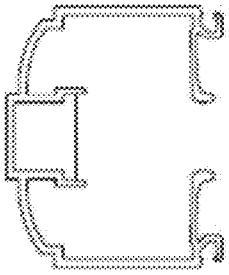
Figure 8E:
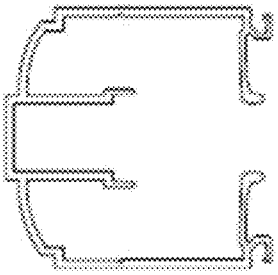
Figure 8F:
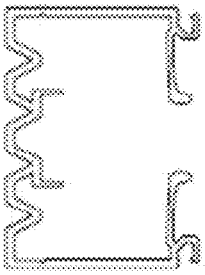
Figure 8G:
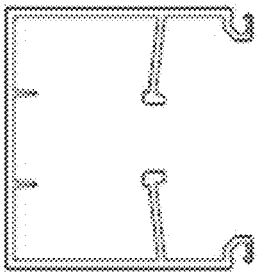
Figure 8H:
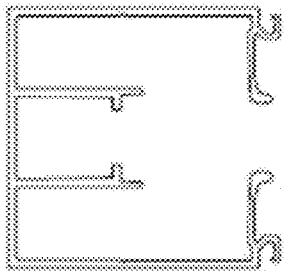
Figure 9A:
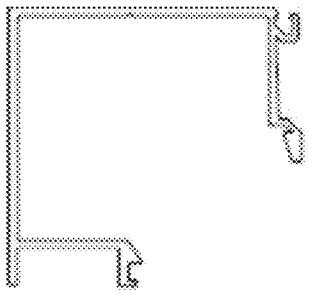
FIGS. 9A-9G are cross-sectional views of a plurality of base caps of a storefront system constructed according to one or more aspects of the present disclosure.
Figure 9B:
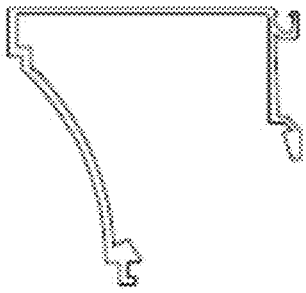
Figure 9C:
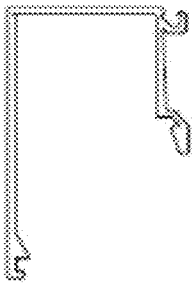
Figure 9D:
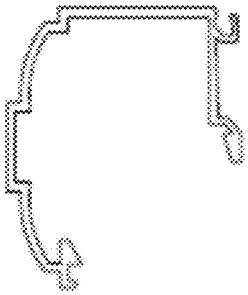
Figure 9E:
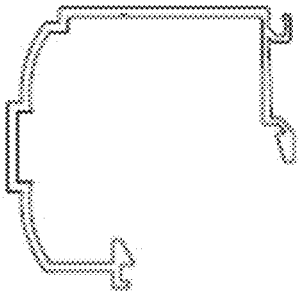
Figure 9F:
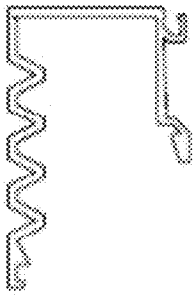
Figure 9G:
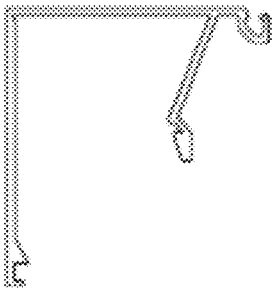

FIG. 7C is a horizontal cross-sectional view of a door assembly attached to a vertical mullion of a storefront system taken along section line 7C of FIG. 7A and constructed according to one or more aspects of the present disclosure. The vertical mullion 750 shares some components with the vertical mullion 400 of FIG. 4A. The vertical mullion 750 of FIG. 7B couples to both a glass panel 752 and to a door frame 754 instead of two glass panels as illustrated in FIG. 4A. The door frame 754 of FIG. 7B may be complementary to the door frame 720 of FIG. 7A so that, in combination, these structures form a double door (outward opening in the described embodiments). Door hinge backing 756 couples to a first piece 758 of the two-piece vertical mullion via screws 760. Door base cap 762 couples to first piece 758 and mullion cap 764 at respective connection points. Hinge 766 couples to door hinge backing 756 through outer mullion cap using screws 768 and to door frame 754 via screws 770. Door frame 754 couples to window frame 756 via bolts 759 and bracket 761. Contained in window frame 756 is double pane glass 763.

FIGS. 8A-8H are cross-sectional views of a plurality of mullion caps of a storefront system constructed according to one or more aspects of the present disclosure. Each of these mullion caps may be installed on any of the previously described mullions, vertical mullions, and/or horizontal mullions. These mullion caps are formed of material commensurate with their installation. For example, mullion caps that are outside mullion caps are formed of a material resistant to weather and that matches other external components. Likewise, mullion caps that are inner mullion caps are formed of material consistent with the interior of a building, e.g., decorative, colored, etc. Further on a single mullion, an internal mullion cap may have a differing design from an external mullion cap. Note that according to some aspects of the present disclosure, mullion caps with a same cross section fit both vertical and horizontal mullions. In this case, only one cross section for mullion caps would be required, reducing manufacturing costs.

FIGS. 9A-9G are cross-sectional views of a plurality of base caps of a storefront system constructed according to one or more aspects of the present disclosure. Each of these base caps may be installed on any of the previously described side pieces or top pieces. These base caps are formed of material commensurate with their installation. For example, base caps that are outer base caps are formed of a material resistant to weather and that matches other external components. Likewise, base caps that are inner base caps are formed of material consistent with the interior of a building, e.g., decorative, colored, etc. Further on a single side piece or top piece, an internal base cap may have a differing design from an external base cap. Note that the symmetry of the side pieces, the top piece and/or the bottom piece allows base caps to be used for all of these. Thus, only one cross section for base caps would be required, reducing manufacturing costs.

FIGS. 10A and 10B are cross-sectional views of door stops of a storefront system constructed according to one or more aspects of the present disclosure. These door stops may mount on a side piece, a horizontal mullion or a vertical mullion and provide a door-stop function. The door stops may be formed in an extrusion process from aluminum, for example.

Figure 11:
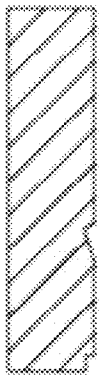
FIG. 11 is a cross-sectional view of a door hinge backing of a storefront system constructed according to one or more aspects of the present disclosure.

FIG. 11 is a cross-sectional view of a door hinge backing of a storefront system constructed according to one or more aspects of the present disclosure. This door hinge backing is also described herein as an anchor member.

FIG. 12A is a cross-sectional view of a side piece a storefront system constructed according to one or more aspects of the present disclosure. Side pieces of this construct are illustrated in FIGS. 3A, 3B, 5A, 5B, and 7B. The side piece may be formed in an extrusion process from aluminum, for example.

FIG. 12B is a cross-sectional view of a horizontal mullion piece of a storefront system constructed according to one or more aspects of the present disclosure. Horizontal mullion piece formed using this component are illustrated in FIGS. 4B and 6B. The horizontal mullion piece may be formed in an extrusion process from aluminum, for example.

FIG. 12C is a cross-sectional view of one-half of a vertical mullion piece of a storefront system constructed according to one or more aspects of the present disclosure. Vertical mullion pieces formed using this component are illustrated in FIGS. 4A, 6A, and 7C. The vertical mullion piece may be formed in an extrusion process from aluminum, for example.

Figure 13:
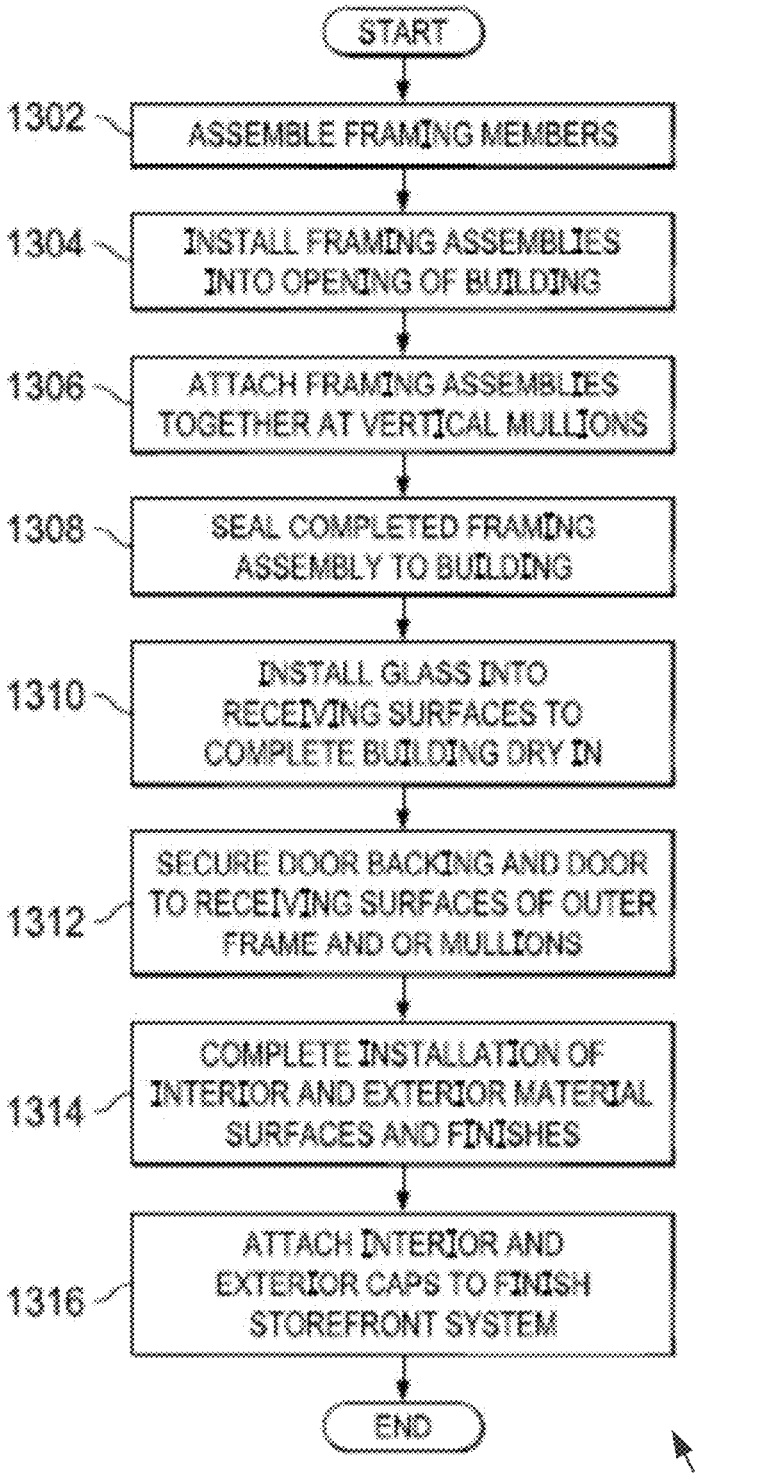
FIG. 13 is a flow chart illustrating installation of a storefront system constructed according to one or more aspects of the present disclosure.

FIG. 13 is a flow chart illustrating installation of a storefront system constructed according to one or more aspects of the present disclosure. Operations 1300 commence with assembling framing members (step 1302), e.g., side pieces, top pieces, bottom pieces, vertical mullion pieces, horizontal mullions, etc. The framing assemblies are then first installed into the opening of the building (step 1304). The framing assemblies are then attached at vertical mullions (step 1306). The completed framing assembly is then sealed to the building using caulking or another sealing material (step 1308). Once the framing of the storefront system is completed, glass is installed into the receiving surfaces to complete the dry-in of the building (step 1310). The door backing and door are then optionally secured to receiving surfaces of an outer frame and/or vertical and/or horizontal mullions (step 1312). Operations 1300 continue with completing installation of interior and exterior material surfaces and finishes (step 1314), which may include drywall on the interior surfaces and stucco, brick, or other finish on the exterior. Finally, interior, and exterior caps (base caps and mullion caps) are attached to finish the door front system (step 1316). Note that step 1316 is the final step of installing the door front system so that the caps are not damaged by any further construction activity.

In the foregoing specification, the disclosure has been described with reference to specific embodiments. However, as one skilled in the art will appreciate, various embodiments disclosed herein can be modified or otherwise implemented in various other ways without departing from the spirit and scope of the disclosure. Accordingly, this description is to be considered as illustrative and is for the purpose of teaching those skilled in the art the manner of making and using various embodiments of the disclosed system, method, and computer program product. It is to be understood that the forms of disclosure herein shown and described are to be taken as representative embodiments. Equivalent elements, materials, processes, or steps may be substituted for those representatively illustrated and described herein. Moreover, certain features of the disclosure may be utilized independently of the use of other features, all as would be apparent to one skilled in the art after having the benefit of this description of the disclosure.

Although the steps, operations, or computations may be presented in a specific order, this order may be changed in different embodiments. In some embodiments, to the extent multiple steps are shown as sequential in this specification, some combination of such steps in alternative embodiments may be performed at the same time. The sequence of operations described herein can be interrupted, suspended, reversed, or otherwise controlled by another process.

It will also be appreciated that one or more of the elements depicted in the drawings/figures can also be implemented in a more separated or integrated manner, or even removed or rendered as inoperable in certain cases, as is useful in accordance with a particular application. Additionally, any signal arrows in the drawings/figures should be considered only as exemplary, and not limiting, unless otherwise specifically noted.

What is claimed is:

1. A method for constructing a storefront system comprising:

prior to dry-in of a building, constructing an outer frame within an external opening of the building by:

attaching a top piece to a top of the external opening of the building, the top piece having a top piece cross section defined by a glass receiving surface, an inner base cap receiving structure, and an outer base cap receiving structure;

attaching a first side piece to a first side of the external opening of the building, the first side piece having a first side piece cross section defined by a glass receiving surface, an inner base cap receiving structure, and an outer base cap receiving structure;

attaching a second side piece to a second side of the external opening of the building, the second side piece having a second side piece cross section defined by a glass receiving surface, an inner base cap receiving structure, and an outer base cap receiving structure; and attaching a bottom piece to a bottom of the external opening of the building, the bottom piece having a bottom piece cross section defined by a glass receiving surface;

after constructing the outer frame within the external opening of the building, mounting glass to the glass receiving surfaces of the top piece, the first side piece, the second side piece, and the bottom piece;

after dry-in and interior wall finishing of the building, attaching a plurality of inner base caps to an interior of the outer frame; and after dry-in and exterior wall finishing of the building, attaching a plurality of outer base caps to an exterior of the outer frame.

2. The method of claim 1, wherein attaching a plurality of inner base caps to an interior of the outer frame comprises:

removably attaching a first inner base cap of the plurality of inner base caps to the inner base cap receiving structure of the top piece;

removably attaching a second inner base cap of the plurality of inner base caps to the inner base cap receiving structure of the first side piece; and removably attaching a third inner base cap of the plurality of inner base caps to the inner base cap receiving structure of the second side piece.

3. The method of claim 1, wherein attaching a plurality of outer base caps to an exterior of the outer frame comprises:

removably attaching a first outer base cap of the plurality of outer base caps to the outer base cap receiving structure of the top piece;

removably attaching a second outer base cap of the plurality of outer base caps to the outer base cap receiving structure of the first side piece; and removably attaching a third outer base cap of the plurality of outer base caps to the outer base cap receiving structure of the second side piece.

4. The method of claim 1, wherein:

the top piece, the first side piece, the second side piece, and the bottom piece are formed of a first material; and the plurality of inner base caps is formed of a second material that differs from the first material and that is less resistance to construction damage than the first material.

5. The method of claim 1:

wherein the first side piece, when in receipt of an outer base cap of the plurality of outer base caps, defines a first side base cap insulating volume; and further comprising depositing an insulating material within the first side base cap insulating volume.

6. The method of claim 1, further comprising anchoring the top piece, the first side piece, the second side piece, and the bottom piece at multiple differing anchor locations within the building opening.

7. The method of claim 1, further comprising sealing the top piece, the first side piece, the second side piece, and the bottom piece within the building opening using an outer sealing flange formed by the top piece, the first side piece, the second side piece, and the bottom piece.

8. The method of claim 1, further comprising:

attaching a horizontal mullion between one side of the outer frame and an opposite second side of the outer frame after the outer frame is secured in the building opening, the horizontal mullion including an inner mullion cap receiving structure and an outer mullion cap receiving structure;

after dry-in and interior wall finishing of the building, attaching an inner mullion cap to an interior of the horizontal mullion; and after dry-in and exterior wall finishing of the building, attaching an outer mullion cap to an exterior of the horizontal mullion.

9. The method of claim 1, further comprising:

attaching a vertical mullion between the top piece and the bottom piece of the outer frame after the outer frame is secured in the building opening, the vertical mullion including an inner mullion cap receiving structure and an outer mullion cap receiving structure;

after dry-in and interior wall finishing of the building, attaching an inner mullion cap to an interior of the vertical mullion; and after dry-in and exterior wall finishing of the building, attaching an outer mullion cap to an exterior of the vertical mullion.

10. A method for constructing a storefront system within an external opening of a building, the method comprising:

prior to dry-in of a building, constructing an outer frame within an external opening of the building by:

attaching a top piece to a top of the external opening of the building, the top piece having a top piece cross section defined by a glass receiving surface, an inner base cap receiving structure, and an outer base cap receiving structure;

attaching a first side piece to a first side of the external opening of the building, the first side piece having a first side piece cross section defined by a glass receiving surface, an inner base cap receiving structure, and an outer base cap receiving structure;

attaching a second side piece to a second side of the external opening of the building, the second side piece having a second side piece cross section defined by a glass receiving surface, an inner base cap receiving structure, and an outer base cap receiving structure; and attaching a bottom piece to a bottom of the external opening of the building, the bottom piece having a bottom piece cross section defined by a glass receiving surface;

after constructing the outer frame within the external opening of the building:

attaching a first door hinge backing to the first side piece;

attaching a second door hinge backing to the second side piece;

attaching at least one first door hinge and a first door to the first door hinge backing; and attaching at least one second door hinge and a second door to the second door hinge backing;

after dry-in and interior wall finishing of the building, attaching a plurality of inner base caps to an interior of the outer frame; and after dry-in and exterior wall finishing of the building, attaching a plurality of outer base caps to an exterior of the outer frame.

11. The method of claim 10, wherein attaching a plurality of inner base caps to an interior of the outer frame comprises:

removably attaching a first inner base cap of the plurality of inner base caps to the inner base cap receiving structure of the top piece;

removably attaching a second inner base cap of the plurality of inner base caps to the inner base cap receiving structure of the first side piece; and removably attaching a third inner base cap of the plurality of inner base caps to the inner base cap receiving structure of the second side piece.

12. The method of claim 10, wherein attaching a plurality of outer base caps to an exterior of the outer frame comprises:

removably attaching a first outer base cap of the plurality of outer base caps to the outer base cap receiving structure of the top piece;

removably attaching a second outer base cap of the plurality of outer base caps to the outer base cap receiving structure of the first side piece; and removably attaching a third outer base cap of the plurality of outer base caps to the outer base cap receiving structure of the second side piece.

13. The method of claim 10, wherein:

the top piece, the first side piece, the second side piece, and the bottom piece are formed of a first material; and the plurality of inner base caps is formed of a second material that differs from the first material and that is less resistance to construction damage than the first material.

14. The method of claim 10:

wherein the first side piece, when in receipt of an outer base cap of the plurality of outer base caps, defines a first side base cap insulating volume; and further comprising depositing an insulating material within the first side base cap insulating volume.

15. The method of claim 10, further comprising anchoring the top piece, the first side piece, the second side piece, and the bottom piece at multiple differing anchor locations within the building opening.

16. The method of claim 10, further comprising sealing the top piece, the first side piece, the second side piece, and the bottom piece within the building opening using an outer sealing flange formed by the top piece, the first side piece, the second side piece, and the bottom piece.

17. The method of claim 10, further comprising:

attaching a horizontal mullion between one side of the outer frame and an opposite second side of the outer frame after the outer frame is secured in the building opening, the horizontal mullion including an inner mullion cap receiving structure and an outer mullion cap receiving structure;

after dry-in and interior wall finishing of the building, attaching an inner mullion cap to an interior of the horizontal mullion; and after dry-in and exterior wall finishing of the building, attaching an outer mullion cap to an exterior of the horizontal mullion.

18. The method of claim 17, further comprising:

attaching a vertical mullion between the top piece of the outer frame and the horizontal mullion after the outer frame is secured in the building opening, the vertical mullion including an inner mullion cap receiving structure and an outer mullion cap receiving structure;

after dry-in and interior wall finishing of the building, attaching an inner mullion cap to an interior of the vertical mullion; and after dry-in and exterior wall finishing of the building, attaching an outer mullion cap to an exterior of the vertical mullion.

* * * * *